United States Patent [19]

Larson

[11] Patent Number: 4,484,782

[45] Date of Patent: Nov. 27, 1984

[54] CUSTOMIZED CHAIR AND METHOD OF MANUFACTURING

[76] Inventor: Jonathan A. Larson, 570 Dayton Ave., St. Paul, Minn. 55102

[21] Appl. No.: 340,590

[22] Filed: Jan. 19, 1982

[51] Int. Cl.[3] ..... A47C 7/02

[52] U.S. Cl. ..... 297/458; 297/284; 297/439; 297/445; 297/463

[58] Field of Search ..... 297/284, 445, 458, 459, 297/463, 439; 29/464, 416, 469; 144/357, 372, 49, 143, 144.5 R, 315 R, 319

[56] References Cited

U.S. PATENT DOCUMENTS

| | | | |
|---|---|---|---|
| 2,359,318 | 10/1944 | Lay et al. | 297/284 |
| 3,081,129 | 3/1963 | Ridder | 297/452 |
| 3,713,696 | 1/1973 | Dudley | 297/458 |
| 3,720,444 | 3/1973 | Uthurriague | 297/445 X |
| 3,877,750 | 4/1975 | Scholpp | 297/284 |
| 3,952,396 | 4/1976 | Werner | 29/416 |
| 3,967,665 | 7/1976 | Lund | 144/372 X |
| 4,126,355 | 11/1978 | Rosenheck | 297/284 |
| 4,278,117 | 7/1981 | Mitchell et al. | 144/372 X |
| 4,367,897 | 1/1983 | Cousins | 297/458 |

FOREIGN PATENT DOCUMENTS

| | | | |
|---|---|---|---|
| 3018323 | 12/1981 | Fed. Rep. of Germany | 297/284 |

*Primary Examiner*—James T. McCall

*Attorney, Agent, or Firm*—Scully, Scott, Murphy & Presser

[57] ABSTRACT

The disclosure relates to a customized chair, a measuring chair, and method of custom fitting a chair produced from standardized components to a unique individual. The chair includes a universal C-frame and a series of standardized upholstered members which serve as supports for the seat, the lumbar region of the back, the thoracic region and the cervical region or neck. These standardized components are fitted together with a unique set of measurements by means of a plurality of molding blocks between the upholstered members and the universal C-frame. A measuring chair for determining the necessary measurements and dimensions is disclosed along with a jig for cutting the blocks as necessary to produce a customized chair with unique dimensions and measurements. The customized chair thereby duplicates the measurements obtained from the individual while sitting in the measuring chair.

19 Claims, 9 Drawing Figures

CUSTOMIZED CHAIR AND METHOD OF MANUFACTURING

BACKGROUND OF THE INVENTION

Throughout history, the design of a good chair that is comfortable for large numbers of people has remained one of the most persistent furniture design problems. This difficulty stems from the fact that people differ significantly in size, shape, and proportion. Individuals of the same height may differ in leg length or back length by several inches, rendering a chair designed for one person totally unsuitable for the other. It is physically impossible to accommodate the whole range of human sizes and proportions in any single design. Prior to the industrial revolution, chairs were custom made one at a time, and if one deviated from the standard size and norm of the mass of individuals, a chair could be easily obtained merely by altering the measurements given to the cabinet maker before the chair was produced. With the onset of the industrial revolution, and the mass production of furniture, the problems of obtaining a good fit in a chair have been substantially compounded. Any design suitable for mass production must necessarily involve compromises to accommodate the largest number of people and therefore the largest possible marketplace. While this process can produce excellent seating, the resulting chairs are only truly comfortable for those who are statistically average in size and proportion.

The problems associated with different sizes and proportions of people can be overcome to some extent by allowing for adjustable sections in the chair. Such chairs are normally found today in dentists' offices, and in prior times were commonly found the barber's shop. In both places, people were obliged to sit for fifteen minutes to an hour at a time without unnecessary movement. Consequently, dentists and barbers sought the most comfortable and adjustable chair possible. These chairs are extremely expensive, prone to wear, and somewhat unattractive for home use. Further, individual seating in a home does not normally involve adjusting a chair for each person who sits in the chair. Man, being a territorial animal, normally gravitates to a certain chair or seating position for any given room. Consequently, a custom chair is the only practical way to provide true comfort and proper support for an individual in a home or office setting.

Customarily, the manufacture of individual, specific sized pieces of furniture is extremely expensive. This is because the jigs, tools, and assembly procedures used to manufacture a standardized chair cannot be broken down quickly and easily to accommodate the wide variety of measurements necessary to customize a chair to an individual. Specifically, in order for a chair to be truly comfortable for an individual, the following variable measurements must be taken into account: (a) the height of the seat above the floor, (b) the length of the seat, (c) the tilt of the seat, (d) the position of the lumbar support, (e) the length of the thoracic support, (f) the tilt of the thoracic support, (g) the position of the cervical support, (h) the length of the arm rest, and (i) the height of the arm rest. While a mass produced chair could probably be produced under conventional techniques with one or two variations in measurements, it has been heretofore virtually impossible to provide for variations of all of the foregoing measurements in a mass produced chair.

Indeed, it is difficult even to obtain the measurements for an individual so that a chair can be produced for that individual. U.S. Pat. No. 3,112,137 which issued to J. B. Drenth on Nov. 26, 1963 discloses a jig for making custom chairs. This jig showed some, but not all, of the adjustments necessary to produce a custom chair. Further, it appears that this jig was used in the production of unique one-of-a-kind chairs, and not in the production of mass produced chairs as is applicant's invention.

SUMMARY OF THE INVENTION

It is therefore an object of this invention to provide a chair which will provide maximum comfort for each individual by customizing the size and proportions of the chair to fit the individual. It is a further object of this invention to provide a measuring chair which will take the very precise measurements necessary to ensure individual comfort when the individual is sitting in the measuring chair. It is another object of the present invention to provide a method of manufacturing a customized chair, tailored to a unique set of measurements, from very standardized components.

It is therefore an object of the present invention to provide a measuring chair which will be adjustable with respect to: (a) the height of the seat above the floor, (b) the length of the seat, (c) the tilt of the seat, (d) the position of the lumbar support, (e) the length of the thoracic support, (f) the tilt of the thoracic support, (g) the position of the cervical support, (h) the length of the armrest, and (i) the height of the armrest. Further, when an ottoman is desired to be produced with the chair, the measurements take into account (j) the height of the ottoman above the floor, and (k) the tilt of the ottoman.

It is another object of the present invention to provide a chair assembled from a plurality of standardized components, to wit a universal C-frame, a C-frame floor mount, and a plurality of standardized support shells which are secured to the universal C-mount by a plurality of support blocks positioned between the shells and the universal C-frames. This method of construction allows the placement of the standardized shells in a wide variety of angles and positions to provide proper support for a unique individual.

It is further an object of the present invention to provide a jig for custom cutting the mounting blocks to conform to the universal C configuration, thereby enabling the manufacturer of such chairs to mass produce the chairs to a custom unique set of measurements for each chair, once the measurements are obtained.

DETAILED DESCRIPTIONS OF THE PREFERRED EMBODIMENTS

The present invention may be divided into three major components; the first being the customized chair produced to a unique set of measurements, the second being the measuring chair which obtains the unique set of measurements, and the third being the method by which the unique chair is produced to the measurements obtained from the measuring chair. The following detailed description will treat these three areas sequentially.

Figure 1:
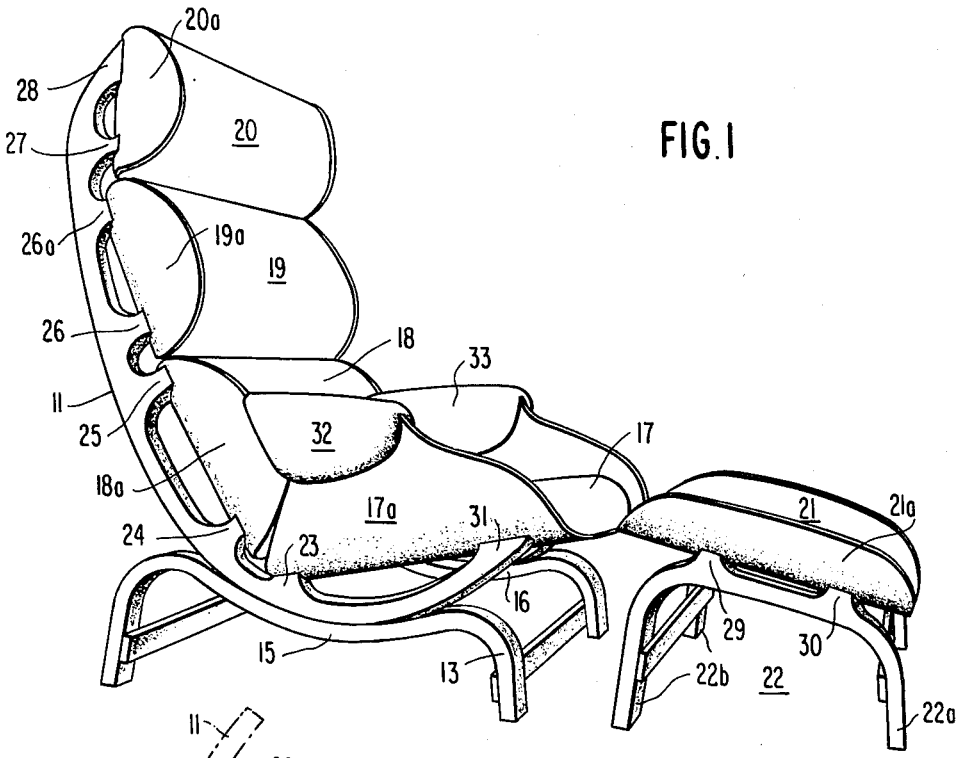
FIG. 1 is an isometric view of a customized chair produced to a unique set of measurements according to the present invention.

A customized chair produced in accordance with the present invention is illustrated in FIG. 1. The chair includes a pair of universal C-frame members 11 and 12 (12 not illustrated in FIG. 1) which underlie the chair and provide a support frame for it. The universal C-frame members are in turn supported by a floor mount 13 which has a pair of cradles 15 and 16 which provide a concave support surface underlying the universal C-member to intimately engage it while at the same time supporting it. The chair also includes a plurality of standardized individual support members which include a seat member 17, a lumbar support member 18, and thoracic support member 19, a cervical support member 20, and an ottoman support member 21. Each of these upholstered support members includes two sections, a rigid outer shell formed from a wooden pressed laminate indicated as 17*a*, 18*a*, 19*a*, 20*a*, and 21*a*, and a cushion member mounted therein. The cushion member may be separately covered with upholstery fabric, leather, plastic, or other suitable covering. In the preferred embodiment, the individualized support members are formed of a wooden pressed laminate having a decorative outer finish and an upholstered member formed of foam rubber with a leather covering. As will be apparent to one skilled in the art, it would also be possible to use a formed plastic such as polyurethane, a plastic shell and plastic simulated Naugahyde covering for the upholstered insert. The ottoman is also provided with a floor support member 22.

The chair also includes a plurality of customized support blocks indicated at 23, 24, 25, 26, 27, 28, 29, and 30. In practice, the universal C-frame member 12 would also include a plurality of support blocks on the other side of the chair to provide a four-point support for each of the upholstered support members. These customized support blocks enable a chair to be mass produced from a plurality of standardized components to a unique set of measurements. By altering the size and spacing of the blocks within the universal C-frame, one is able to alter the size, angle and measurements of each of the various support members, thereby enabling the chair to be truly customized to a unique set of measurements. As illustrated in FIG. 1, the support block for the front of the seat is in actuality a portion of the C-frame indicated at 31. Depending on the size of the individual and the angle or orientation of the seat desired, support blocks may be used or the C-frame may be cut and used for either end of the universal C-frame mount.

The wooden pressed laminate shell 17*a* also defines a pair of armrests with upholstered portions 32 and 33 which are custom tailored to each unique individual.

The range of measurements and adjustments capable of being incorporated in the chair illustrated in FIG. 1 will be discussed with respect to FIG. 5. It should be noted that the discussion of FIG. 5 is applicable not only to the customized chair illustrated in FIG. 1, but also to the measuring chair illustrated in FIG. 3.

Figure 5:
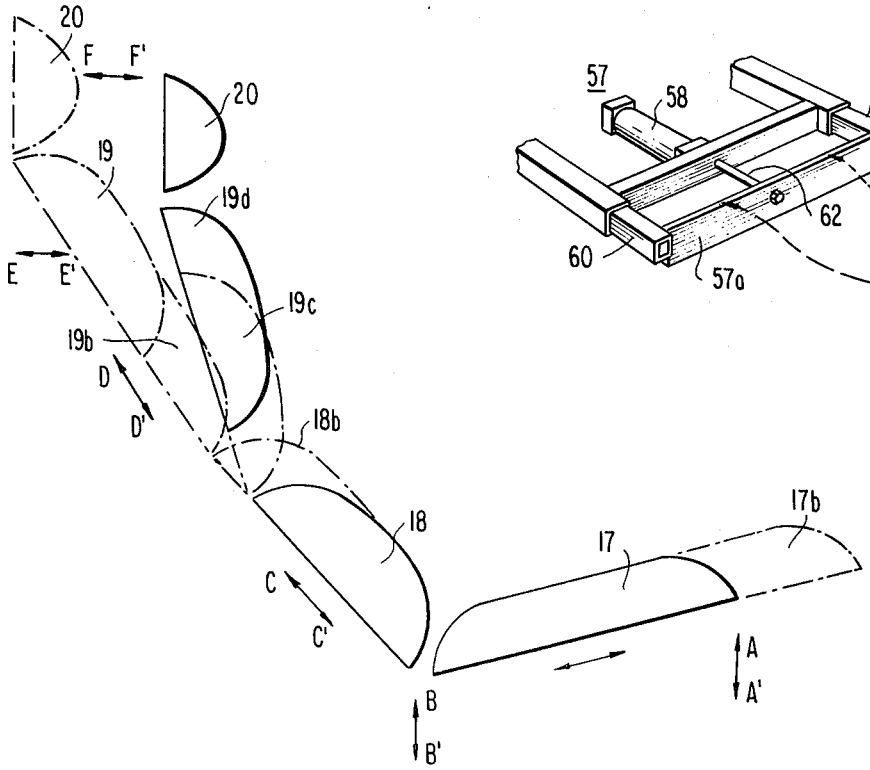
FIG. 5 is a diagrammatic view illustrating the range of measurements available with the measuring chair and the customized chair of the present invention.

The seat member 17 illustrated in FIG. 5 has three principal adjustments or measurements. The first is seat height, the second is seat tilt, and the third is seat length. The height of the seat should be slightly less than the sitter's lower leg so that the feet may rest on the floor and the legs can be relaxed. Low chairs are extremely difficult to get into and out of gracefully and comfortably. Conversely if the chair is too high, a pressure point is created behind the knee, and in extreme cases, a seat that is too high will cause the feet to dangle which is undignified for the sitter if nothing else. The seat height is adjusted by altering the legs of the chair which are indicated at A–A′ and B–B′ in FIG. 5. In addition to seat height, the measurements A–A′ and B–B′ also determine the tilt of the seat. The tilt of the seat should be great enough to allow the back to support some of the weight which is important to those of slender builds while not being tilted so far as to make getting in and out of the chair difficult, a consideration which is more important to those of heavier builds. The tilt of the seat also determines whether the chair is to be used as a recliner or as a work chair.

The seat length which is indicated by 17 and the dotted line 17*b* is adjustable by using four different standardized sizes of seat members and positioning the members within the universal C-frame. The positioning of the members accommodates the differences between sizes of the standardized inserts. The length of the seat must be long enough to distribute the sitter's weight comfortably along the full length of the thighs, but it should not be so long as to create a pressure point behind the knee or rub against the calves of the legs.

The lumbar support 18 is also adjustable both as to height, as indicated by the letters C–C′, and as to length indicated by the solid lines for member 18, and the dotted lines for 18*b*. The lumbar support is perhaps the most critical support of the seat. Not only must the spine be supported in a convex shape, but a lumbar support set at the proper angle will actually give an upward lift to the back which will allow the muscles in that region of the back to relax. Not only is this healthful and comfortable, but can also give orthopedic support for persons who have damaged their lower back muscles.

The thoracic section of the chair is adjustable in three different dimensions; the first dimension being the length of the thoracic support which is indicated by 19 and 19*b*, the height of the thoracic support which is indicated by D–D′, and the tilt of the thoracic portion which is indicated by the arrows E–E′. Variations in back length are primarily accommodated through four standardized sizes for the thoracic support 19. The proper spacing of the thoracic section of the back is accommodated by the adjustment indicated at D–D′ while the proper angle for the back is indicated by the adjustment E–E′. Adjustment E–E′ not only provides the amount of support for the thoracic portion of the back, but also for the lumbar support. The angle between the lumbar support and the seat support is fixed. However, by varying the angle of the thoracic support, the relative amount of support afforded the back by the lumbar support is varied. If the lumbar support is reclined to the rearward direction as indicated by E–E', the relative advancement of the lumbar member 18 provides strong lumbar support for the lower back. As the thoracic section is moved forward in the direction indicated by arrow E', the relative support between the thoracic portion and the lumbar support is equalized.

It should be pointed out at this juncture that the relative amount of support afforded both the thoracic section and the lumbar section can be altered by providing different densities of foam in the upholstered inserts placed in the shells for the thoracic and lumbar section. In the preferred embodiment, two different densities of foam are used which give four possible subcombinations of support between the thorax and the lumbar support. It would of course be possible to use three different densities with nine possible subcombinations.

The cervical support 20 is adjustable as indicated by the arrows F–F'. While the height of the cervical portion varies according to the height of the thoracic and lumbar portions, it maintains a relatively fixed relationship between the top of the thoracic support and the center of the cervical support. The lateral displacement indicated by F–F' is very important to comfort. It appears that optimum comfort is derived from supporting the neck and curving the headrest back so that the weight of the head rests gently on the top side of the curve. It is important that the head be held upright for conventional activities such a reading, watching television, listening to the stereo, or conversing with other members of the family.

Referring again to FIG. 1, the armrests 32 and 33 are adjustable to provide effective armrests for persons having different arm lengths. To be effective, the armrest should be parallel to the floor and originate at a line which would pass through the spine and extend forward to the ribs. This allows for an ideal elbow rest so that reading material can be placed in a relaxed position in front of the face while also supplying a restful place for the forearms. If the armrests are too low, the shoulders are forced into an uncomfortable droop, and if they are too high, they are simply unusable or extremely uncomfortable. In practice, the armrest height is obtained by measuring the position of the elbow with respect to the lumbar support and cutting the pressed laminate shell 17*a* at that point as will be hereinafter later described in detail. It should be noted that as the tilt for the chair varies, the relative angle at which armrest 32 is cut needs to be varied to maintain the top of the armrest in a position parallel to the floor.

Figure 2:
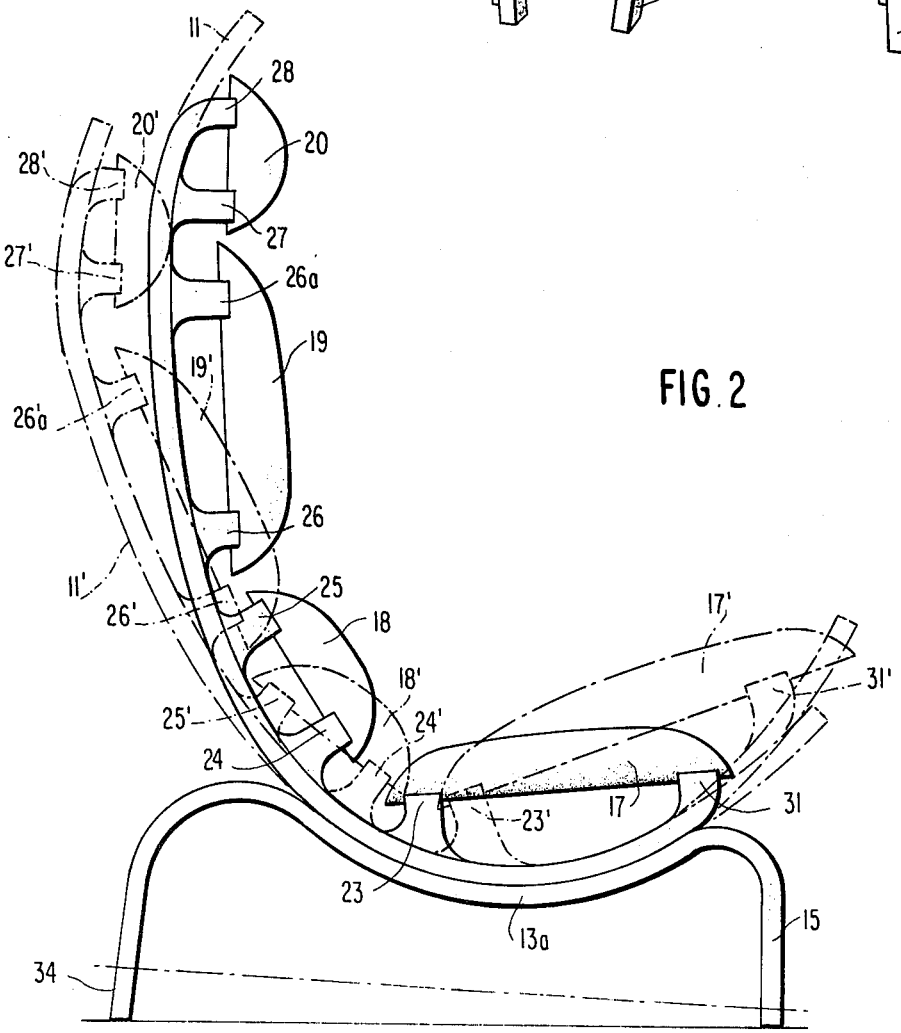
FIG. 2 is a diagrammatic side view of the chair illustrating some of the variations possible with the universal C-frame construction.

FIG. 2 illustrates two ways in which seat tilt can be altered in the present invention. By altering the length of the legs 15 and 34, the tilt angle of the seat is changed. Conversely by rotating the universal C-frame member 11 within the concave portion 13*a* of the floor support member, one is also able to change the tilt of the seat. In actual practice, both adjustments may be used to provide for the maximum esthetic combination. FIG. 2 also illustrates two variations possible with the universal C-frame configuration. The solid lines of FIG. 2 illustrate a chair for a relatively small individual in an upright position. The dotted lines in FIG. 2 illustrate a chair for a much larger individual in a semi-reclined position. As is apparent from comparing the seat members 17 and 17', their relative position within the C-frame and the size of wooden spacing blocks is varied substantially. As illustrated in FIG. 1, the terminus of the universal C-frame member 31 may provide the extreme support for the seat shell 17*a*. Likewise, as illustrated in FIG. 2, the wooden support blocks 31 and 31' can be contoured with the universal C-frame member to maximize the esthetic appeal of the chair. Support blocks 28 and 28' are also combined with the termination of the universal C-frame members 11 and 11' to provide the maximum possible esthetic appeal. In some extreme cases, the wooden support blocks indicated at 31 and 31', 28 and 28', may not be needed and the universal C-frame members 11 and 11' may be contoured to provide for the proper support of those members.

FIG. 2 illustrates chairs designed for two different sizes of individuals with different proportions. As illustrated, 18 and 18' are the same size, 19 and 19' are the same size, and 20 and 20' are the same size, but seat members 17 and 17' are of different sizes. The relative spacing and angular orientation of the elements is also substantially different. This is because individuals vary greatly in the relative proportion of their respective body lengths, even among different sized individuals. As illustrated in FIG. 2, the individuals have substantially the same size back lengths, but substantially different leg lengths. One individual measured for the present invention who was 5'9" tall had a back length longer than another individual who was 6'5" tall. The present invention enables the customized chair to provide maximum flexibility in the placement and lengths of the various components.

Figure 3:
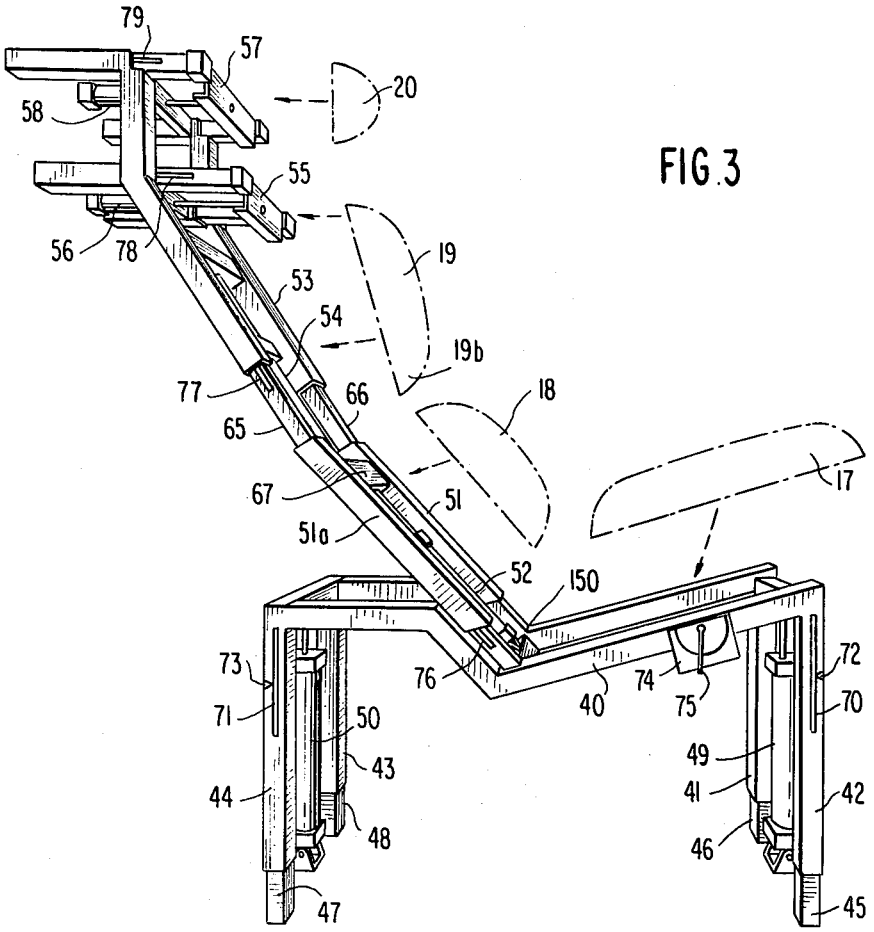
FIG. 3 is an isometric view of the frame and subframe assemblies of the measuring chair of the present invention.

FIG. 3 illustrates the measuring chair used in the present invention to precisely determine the measurements and proportions of the unique individual for whom the customized chair is to be manufactured. The measuring chair defines a lower frame member 40 having a front pair 41, 42 and a rear pair 43, 44 of legs which reciprocate on support members 45, 46 and 47, 48. The lower frame member 40 is supported by means of hydraulic cylinders 49 and 50 stabilized by means of the reciprocating leg members 41–44. The lower frame member 40 carries with it three sub-frame assemblies that extend upwardly from the seat lumbar apex 150. The first movable sub-frame 51 carries the lumbar support and reciprocates upwardly and rearwardly as illustrated in FIG. 3 by means of hydraulic cylinder 52. Attached to sub-frame member 51 is a thoracic sub-frame 53 which reciprocates upwardly and rearwardly by means of hydraulic cylinder 54. Attached to the upper portion of sub-frame 53 is the second thoracic sub-frame 55 which reciprocates horizontally by means of hydraulic cylinder 56. Attached to the upper portion of thoracic sub-frame 53 is a cervical sub-frame 57 which reciprocates horizontally by means of hydraulic cylinder 58.

As can be seen from FIG. 3, moving the lumbar sub-frame assembly 54 upwardly carries with it the thoracic sub-frames 53 and 55 as well as the cervical sub-frame 57.

Figure 4:
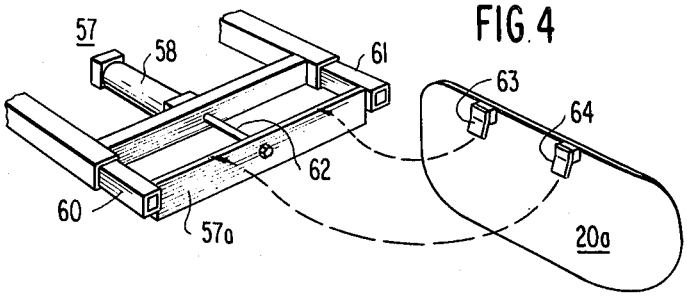
FIG. 4 is a diagrammatic view illustrating the manner in which the upholstered support members are attached to the measuring chair sub-frames.

Attached to each of the sub-frames is an upholstered support cushion, (illustrated by dotted lines in FIG. 3) which clips over the movable sub-frames and defines a chair for the individual to be seated in. As illustrated in FIG. 4, the cervical sub-frame 57 defines a pair of reciprocating tubes 60 and 61 with cross-bar means 57*a* which is attached by means of push rod 62 to the hydraulic cylinder 58. A cervical support member 20 defines on its outer surface a rigid shell 20*a* which has mounted thereon a pair of clips 63, 64 which clip over the cross-bar 57*a*. Likewise, movable sub-frame assembly 55 supports the upper end of thoracic cushion 19 while the lower end of the thoracic cushion designated as 19*b* rests against the stationary part of the thoracic sub-frame 65 and 66. Thus as the thoracic sub-frame 55 is reciprocated outwardly, the thoracic support 29 pivots slowly about the contact points 65 and 66 on the thoracic sub-frame to assume a more upright position. As the hydraulic cylinder 56 is withdrawn, the upper thoracic sub-frame reciprocates rearwardly drawing the cushion into a more obtuse angle with respect to the seat.

Similarly, the lumbar support 18 is hooked over a planar member 67, extending between the upright portions 51 and 51*a* of the lumber sub-frame. As the lumbar sub-frame is driven upwardly by hydraulic cylinder 52, the lumbar support is also raised.

The seat member 17 is provided with a pair of hooks (not shown) or velcro fasteners which engage portions of the lower sub-frame assembly 40 and hold it in position during the trial fitting.

As was indicated previously, the seat portion and thoracic portion are equipped with four standardized sized shells to accommodate the chair to various sizes of individuals. The lumbar support may be equipped with two different sizes, while a single size is generally sufficient for the cervical support. The alignment and positioning of the various sub-frames 51, 53, 55, and 57 provides for a detailed adjustment of the chair to meet the needs of a specific and unique individual.

In actual operation, an individual is seated in the measuring chair illustrated in FIG. 3 with each of the seat, lumbar, thoracic, and cervical cushions in place. The seat length is adjusted first to match the seat to the length of the thighs of the individual. Hydraulic cylinders 49 and 50 are then adjusted to provide for a proper leg length and tilt of the seat. The thoracic support cushion 19 is retracted fully and the lumbar support is raised to the most comfortable position. The thoracic support is then raised or lowered as necessary to provide for the proper length of the thoracic support cushion. After determining the proper length, hydraulic cylinder 56 is energized and the proper tilt for the thoracic support 19 is determined. As mentioned previously, the movement of sub-frame 55 determines not only the tilt of the thoracic cushion 19, but also the amount of support afforded by the lumbar support member 18.

After the thoracic and lumbar supports are positioned properly, the cervical support means is moved forwardly to engage the customer's head. As mentioned previously, the positioning of the cervical support 20 varies substantially from individual to individual, and also varies with respect to the functions that are normally to be performed while in the chair. A work oriented chair requires a forward mounted cervical support, while a chair intended for more relaxed activities requires a retracted cervical support.

Attached to legs 42 and 44 are scales 70 and 72 with pointers 72 and 73. These scales and pointers determine an arbitrary measurement to the floor which will determine the ultimate chair height for the customized chair. Also attached to the lower sub-frame is protractor 74 with a movable pointer 75 that its moved to a vertical position after the seat tilt adjustment has been made. Attached to each of the sub-frames are indicator scales 76, 77, 78 and 79 which provide a measurement indicative of the vertical travel of each of the respective sub-frames. Scales 78 and 79 provide measurements for the amount of horizontal travel of sub-frames 55 and 57. As each of the sub-frames is reciprocated upwardly or outwardly, they uncover additional portions of scales 76–79 to provide a mathematical reference point for each respective sub-frame.

Figure 6:
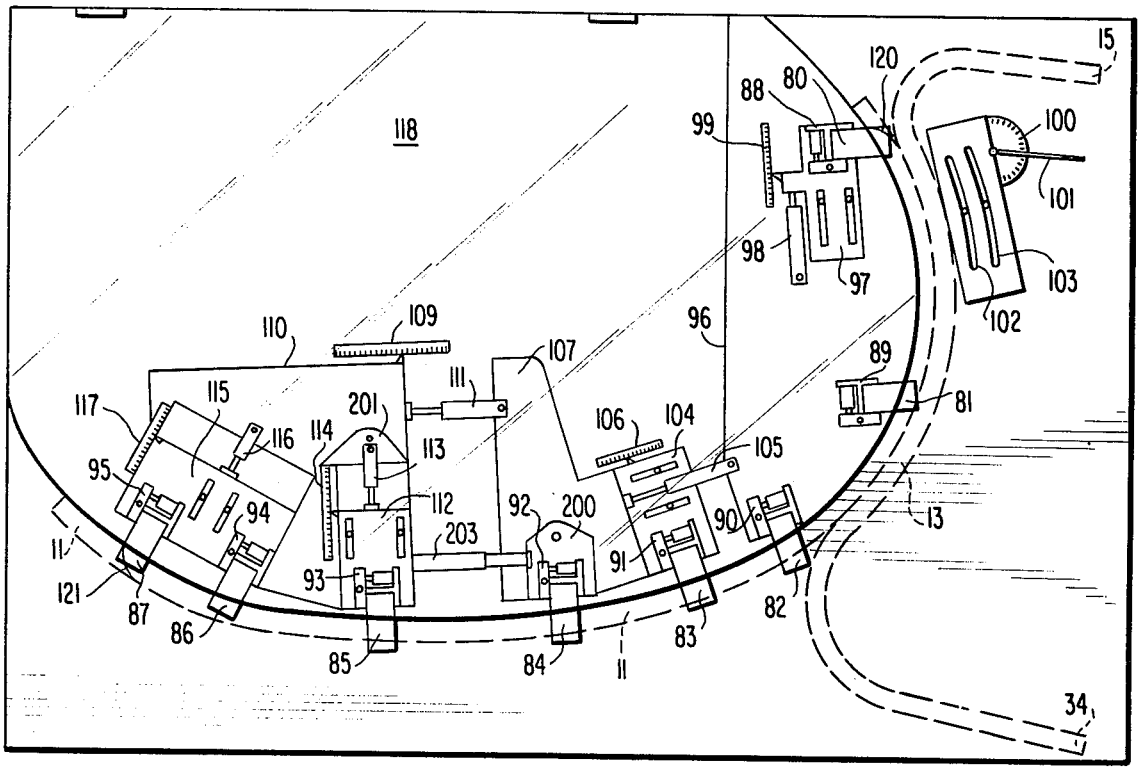
FIG. 6 is an above plan view of the jig used in manufacturing customized chairs of the present invention.

The mathematical measurements obtained by scales 70, 71 and 76–79 are then transferred to the block-cutting jig illustrated in FIG. 6. As illustrated in FIG. 6, the block-cutting jig has clamped therein a plurality of wooden blocks 80–87. The wooden blocks are clamped into place by means of a plurality of pneumatic clamps 88–95. The pneumatic clamps are carried on frames and sub-frames corresponding in motion to the frames and sub-frames of the measuring chair illustrated in FIG. 3. The outline of the universal C frame member 11 is illustrated in dotted lines in FIG. 6. Likewise the outline of the lower floor support member 13 is illustrated in dotted line providing proper reference points for the application of the principals involved in cutting the blocks for a customized chair. In actual practice, the placement of the blocks and the cutting of the blocks is performed without the C frame and floor support members in place. The primary frame 96 corresponds in relative placement to the lower sub-frame member 40 of the measuring chair. It has mounted thereon a fixed block clamp 89 for the seat and a fixed block clamp 90 for the lower lumbar support. The relative positioning of these two blocks remains constant. Block clamp 88 reciprocates horizontally on carrier means 97 by means of hydraulic cylinder 98. The scale 99 for movable sub-frame 97 corresponds to the four different sizes of seat members used in the present invention. It would also be possible to provide a scale on the lower frame member 40 and custom cut the lower seat shell as desired to a specific measurement. In actual practice, using four separate shells, and positioning the shells slightly forward or slightly rearward of each standard position, it has been found possible to accommodate all ranges of sizes necessary to provide a truly custom fit. Also mounted on the primary frame 96 is protractor 100 and a movable pointer 101, which is set to the tilt angle derived from the unique and individual set of measurements. As has been indicated previously, the tilt angle can be achieved by cutting the lengths of leg members 15 and 34 or by rotating the universal C with the floor support member 13. Rotation of the universal C within the floor support member 13 is factored into the protractor angle by means of curved slots 102 and 103. As was indicated previously, the tilt angle can be derived entirely from the orientation of the C, entirely from the respective lengths of legs 15 and 34, or from a combination of the two factors. Attached to main frame 96, is a lumbar sub-frame 104 which is reciprocated upwardly by means of hydraulic cylinder 105. The scale 106 corresponds to scale 76 on the lumbar sub-frame on the measuring chair. Also attached to main frame 96 is the thoracic sub-frame 107 which is reciprocated upwardly by means of hydraulic cylinder 105. The adjustment for thoracic sub-frame 107 is determined by transferring the measurement obtained from scale 77 to scale 109 on the upper thoracic sub-frame. The upper thoracic sub-frame 110 is reciprocated upwardly by means of hydraulic cylinder 111 to place the mounting block 85 at the upward position determined by thoracic sub-frame 55 and scale 77. Hydraulic cylinders 105 and 111 are then balanced to provide for the proper location of support block 84. This location is determined by the size of the thoracic support used and the relative spacing between the seat, the lumbar portion, and the thoracic portion. The horizontal tilt motion of the upper thoracic support is derived by moving sub-frame 112 through hydraulic cylinder 113. The measurement taken from scale 78 is transferred to scale 114 on the upper thoracic sub-frame.

Attached to the upper thoracic sub-frame 110 is a cervical sub-frame 115 which carries block mounting jigs 94 and 95. These jigs are reciprocated laterally by means of hydraulic cylinder 116 to a position on scale 117 that corresponds to the respective scale setting on scale 79.

After each of the blocks 80–89 has been clamped in place, and each of the frames and respective sub-frames moved to its scale location determined by the measurements taken from the measuring chair, a transparent template 118 is lowered over the blocks. While the position of template 118 is illustrated as hinged to frame 96 in FIG. 6, it should be emphasized that in actual practice it is preferred to allow template 118 to float into position to enable a final positioning of the template with respect to the blocks 80–87 to provide for the maximum possible esthetic contours between the universal C-frame and the adjustable mounting blocks. After the template 118 has been positioned, blocks 80–87 may be marked for cutting, or may be routed in place.

After the blocks 80–87 have been cut, the universal C-frame 11 is placed in position and trimmed according to the cut mark 120 and 121 to provide an esthetic contour at each end of the universal C-frame member. The blocks may then be fitted for trial assembly on the universal C member 11, or they may be cut for contouring directly.

The block mounting jigs 91 and 93 used for the thoracic support member are mounted on pivoting carriages 200 and 201, that enable them to maintain a parallel alignment along the block faces as the thoracic tilt is adjusted by hydraulic cylinder 113. A sliding guide tube 203 is rigidly attached to the block jigs 92 and 93 to maintain the parallel alignment regardless of the thoracic tilt entered on scale 114 by hydraulic cylinder 113.

Figure 8:
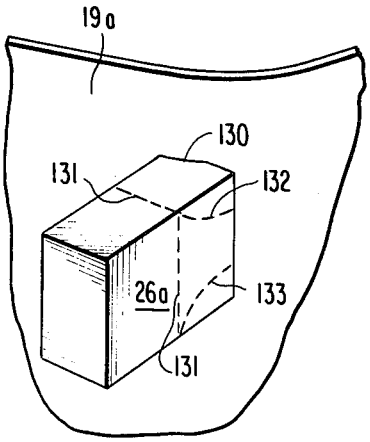
FIG. 8 is an isometric view of one of the mounting blocks and typical cut lines.

FIG. 8 illustrates a sample block and rigid shell and the manner in which the block is cut. As illustrated in FIG. 8, the upper thoracic shell 19*a* is illustrated with one of the adjustable mounting blocks 26*a* in position. Mounting block 26*a* has a curved face 130 on one end thereof to provide a smooth engagement with the curved shell 19*a*. The cut line indicated by dotted line 131 is indicative of the cut line transcribed by the template means 118. After the template cut 131 has been made, a separate pair of cuts 132 and 133 may also be made to trim the block for esthetic considerations. As illustrated in FIG. 1, each of the blocks 23–30 is gracefully contoured into the configuration of universal C-frame member 11 to provide a chair that is esthetically pleasing as well as orthopedically correct.

Figure 7:
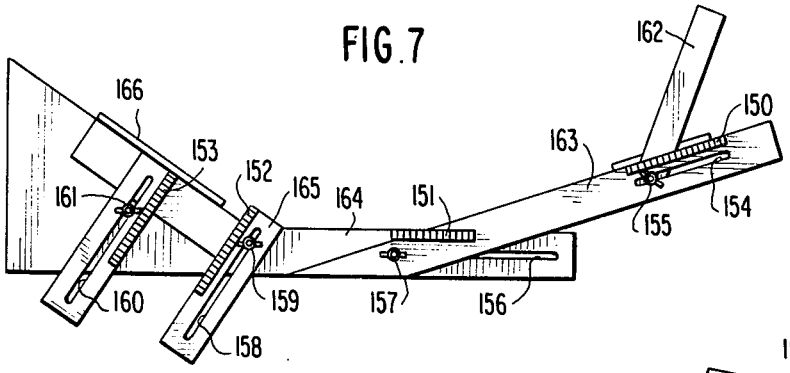
FIG. 7 is a plan view of a measuring stick that may also be used in the manufacture of chairs according to the present invention.

For simpler manufacturing operations, a simpler jig may be provided than the jig illustrated in FIG. 6. In the simplified embodiment, the blocks 80–87 are retained by movable pneumatic clamps 88–95 in the same manner as that illustrated in FIG. 6. However, there is no need for the hydraulic cylinders illustrated previously with respect to FIG. 6. In lieu of these, the measuring stick illustrated in FIG. 7 is utilized. The measuring stick illustrated in FIG. 7 has thereon a plurality of scales that correspond to scales illustrated on the measuring chair in FIG. 3. Scale 150 corresponds to scale 76, scale 151 corresponds to scale 77, scale 152 corresponds to scale 78, and scale 152 corresponds to scale 79. The adjustable thumb screws and slots provide for reciprocation of various elements in a manner similar to that of the measuring chair illustrated in FIG. 3. The slot 154 and thumb screw 155 provide for movement along scale 150 in the same manner as that afforded by the movement of lumbar sub-frame member 51. Likewise, slot 156 and thumb screw 157 provide for movement similar to the movement afforded by thoracic sub-frame 54. Slot 158 and thumb screw 159 provide for movement similar to that of the upper thoracic sub-frame 55. Slot 160 and screw 161 provide for movement corresponding to the movement of upper sub-frame 57. The measuring stick illustrated in FIG. 7 has a first seat member 162 which corresponds to the lower frame 40 of the measuring chair illustrated in FIG. 3. It also contains a lumbar portion 163, a first thoracic portion 164, an upper thoracic portion 165, and a reciprocating T-head 166 which corresponds to the cervical sub-frame.

In use, the measuring stick is adjusted to the scale measurements derived from the measuring chair illustrated in FIG. 3. It is then placed adjacent reference marks near the block holding clamps 89–95 and each of the clamps are then moved into location to provide a smooth fit along the surface of the measuring stick. For example preset reference marks for each of the block holding clamps 94 and 95 are aligned to conform with the outer T-surface 166 on the cervical portion of the measuring stick. The block-holding clamp 93 is moved until its reference mark conforms to the lateral displacement of portion 165 of the measuring stick. When used in this manner, the block holding clamps are then bolted in position according to the measurements derived from the measuring stick illustrated in FIG. 7. The template 118 is then lowered over the blocks to describe the universal C surface in a manner previously described with respect to FIG. 6. The blocks may then be cut by hand or cut with a router to conform to the configuration of the universal C. Likewise, once the universal C configuration has been cut, each of the blocks may be further shaped to provide for esthetic contours as was previously described with respect to FIG. 8.

The predetermined reference marks used with the measuring stick are carried by each of the block-holding clamps 88–95 and are used to provide a 34 mm setback between the measuring stick and the face of the clamps. Any setback distance may be selected so long as the inward facing side of the mounting blocks when mounted in the clamps 88–95 corresponds to the outward facing surface of the support members 17–20 carried by the measuring chair at the time the measurements are taken.

As illustrated in FIG. 1, the chair may also be equipped with an ottoman having front legs 22*a* and rear legs 22*b* which are cut to provide an ottoman with the correct height and tilt. The tilt of the ottoman is selected primarily on esthetic grounds to provide a downward tilt that corresponds to the upward tilt of the seat. In practice it has been found that the angle of 135° to 140° between the angle of the lower seat member and the ottoman provides a corresponding tilt that is both comfortable and esthetically pleasing. The rearward legs of the ottoman are cut to provide approximately a 35 mm drop between the upper surface of the ottoman and the upper surface of the seat member 17. This drop is necessary inasmuch as stiffer foam is used in the seat member 17 than is used in the ottoman cushion 21. In addition, there is also substantially more weight carried by seat member 17 than by the ottoman and the 35 mm difference is necessary to provide for the difference in the foam compression between the seat and the ottoman.

Figure 9:
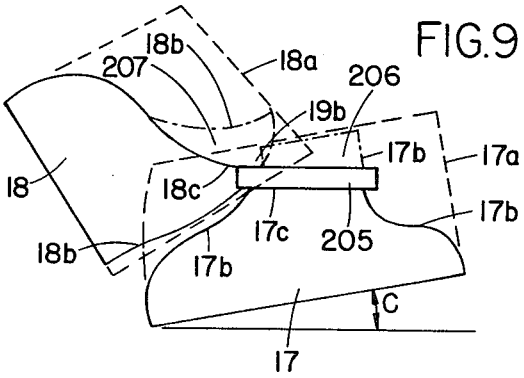
FIG. 9 is a side profile of the seat member, the lumbar member and arm rest, before and after cutting.

FIG. 9 is a side profile view of a seat member, the lumbar member, and the armrest support before and after cutting. Each of the shells 17 and 18 is provided with a planar curved surface the perimeters of which are illustrated in elevation side views by the dashed lines 17*a* and 18*a* in FIG. 9. This enables the use of a laminated veneer construction for the outer shell portions of seat members 17 and 18. In forming the armrest, it is necessary to cut a matching joint between the seat member 17 and the lumbar member 18 that will be both functional and esthetically pleasing. This is accomplished by laying templates to correspond to the solid and dash-dot lines 17*b* and 18*b* in FIG. 9. The first pair of cuts on member 17 correspond to the solid line 17*b* and the dot-dash line 17*b*. This provides an upstanding armrest portion 206 that is later trimmed to the correct armrest height. Likewise, member 18 is trimmed along the solid line 18*b* and the dot-dash line 18*b* to provide an esthetic curve that corresponds with the facing curve 17*b* on the seat member 17. Likewise, it defines a portion 207 which is later cut to conform to the exact height of the armrest.

The height for the armrest is determined by measuring the distance from the elbow to a predetermined point on the lumbar sub-frame 51. Any point may be selected so long as the same point is used for each person, and a corresponding reference point is selected along the lumbar sub-frame 18. The purpose of the cut is to provide an armrest that is parallel to the floor and at the proper distance from the individual's shoulder to be functional and comfortable. As illustrated in FIG. 9, the final cut to select the armrest could be made anywhere along portion 206 depending on the length of the individual's arms. The final cut as illustrated in FIG. 9 is made along the line 17*c* for member 17 and 18*c* for member 18. The cut line 18*c* is used to provide a contour that is esthetically pleasing and will match the armrest height defined by the cut 17*c*. The lumbar support 18 and the seat support 17 are then joined together by means of the armrest support member 205. Armrest support member 205 is then covered with the pads 32 and 33 illustrated in FIG. 1.

Thus it can be seen that the present invention provides a method and means of producing a unique and novel customized chair from a unique set of measurements obtained from a specific individual. The measuring chair illustrated in FIG. 3 obtains specific measurements including the height of the seat, the length of the seat, the tilt of the seat, the position of the lumbar support, the length of the thoracic support, the tilt of the thoracic support, and the position for the cervical support necessary to ensure comfort for the individual being measured. The block cutting jig illustrated in FIG. 6 positions the blocks in accordance with the specific measurements obtained and enables the manufacturer of the chairs to quickly and easily transfer a complex set of dimensional relationships into a simple cut line. Thus it is possible to provide a customized chair having seat, lumbar, thoracic, and cervical portions that are completely customized to a specific individual by customizing the support blocks between the support members and the universal C. By using standardized components and the universal C, it is possible to use the time and economies present in mass production to produce a completely customized and unique chair through the use of the mounting blocks and block-cuting jigs illustrated in FIG. 6.

I claim:

1. A standardized chair configuration that enables a customized chair to be manufactured to a unique set of measurements, said chair comprising:

(a) at least one universal one piece C-frame member, said C-frame extending under the chair and providing a support frame for the chair, (b) a floor mount for supporting said C-frame member on a floor, (c) a plurality of standardized individual upholstered support member, said members providing at least an upholstered seat support, an upholstered lumbar support, an upholstered thoracic support, and an upholstered cervical support for said chair, (d) at least one customized support block mounted between each of said upholstered support members and said universal C-members to provide unique individualized placement for each of the upholstered support members, said blocks providing for radial, circumferential and angular positioning of the support members, whereby a standardized chair may be customized to a unique set of measurements by said blocks before they are placed between said upholstered support members and said universal C-member.

2. A standardized chair configuration as claimed in claim 1 wherein said floor mount defines four legs and a concave support means, said concave support means underlying said universal C-member to intimately engage said C-member while supporting it.

3. A standardized chair configuration as claimed in claim 2 which further includes customized seat height and tilt measurements, said seat height being determined by the length of said legs, and said tilt being determined by the length of said legs, the rotation of said universal C within said concave support means, or a combination of both.

4. A standardized chair configuration as claimed in claim 1, wherein said unique set of measurements includes a lumbar support measurement and dimension, a thoracic support measurement, dimension, and tilt, and a lateral cervical measurement.

5. A standardized chair configuration as claimed in claim 1, wherein said standardized upholstered support members are formed of a wooden press laminate shell generally curved to form a concave recess, and a cushioned member mounted within said concave recess.

6. A chair, said chair having a universal C-frame member, a seat support member, a lumbar support member, a thoracic support member, and series of mounting blocks for said support members, said blocks extending between the respective support members and universal C wherein said chair is a product of the process of:

(a) measuring the seat height, the seat tilt, the lumbar height, the thoracic height and the thoracic tilt adjustment desired by an individual, (b) positioning said mounting blocks in a block-cutting jig according to the measurements derived from measuring said individual, (c) cutting said blocks to conform to said universal C contours, (d) assembling said support members, said mounting blocks and at least one universal C-frame into a chair, whereby said process produces a chair that provides a unique fit for the individual measured.

7. A chair as claimed in claim 6, wherein the process further includes measuring a cervical displacement desired by said individual, positioning and cutting at least one cervical block for a cervical support member, and assembling said cervical support member and said block onto said universal C member.

8. A chair as claimed in claim 6, wherein the process further includes positioning and cutting a base support member for said universal C, wherein the base support member is cut to determine the seat height of the chair.

9. A chair with a universal C-frame member, a universal C support member, a seat support member, a lumbar support member, a thoracic support member, and a cervical support member with a plurality of mounting blocks between said universal C-frame member and said support members, wherein said chair is a product of the process of:

(a) measuring the seat height and dimensions, the seat tilt, the lumbar support height and dimensions, the thoracic support height, tilt and dimensions, and the cervical adjustment desired by an individual while sitting in an adjustable measuring chair, (b) transferring the measurements and dimensions from said adjustable measuring chair to a block-cutting jig, (c) positioning said plurality of mounting blocks according to the measurements and dimensions obtained from the adjustable measuring chair, (d) cutting one side of said mounting blocks to conform to said universal C configuration, (e) assembling said support members, said mounting blocks, and at least one universal C-frame into a chair and mounting said assembly on said seat support member.

10. A process of manufacturing a customized chair, said process comprising:

(a) measuring a seat height and dimension, a seat tilt angle, a lumbar height and dimension, a thoracic height, tilt and dimension, and a cervical adjustment desired by an individual while said individual is sitting in an adjustable measuring chair, (b) transforming the measurements obtained to a block-cutting jig, (c) positioning a plurality of intermediate support blocks in said block-cutting jig in a predetermined pattern, wherein said predetermined pattern is altered by the measurements obtained from the adjustable measuring chair, (d) cutting said blocks to conform to the radii of a universal C-member, (e) assembling said blocks on said universal C-member to form a seat frame, (f) mounting a seat member, a lumbar support member, a thoracic support member, and a cervical support member on said seat frame, (g) attaching said seat frame to a floor support member with the seat height determined by said floor support member.

11. A process of manufacturing a customized chair as claimed in claim 10, wherein said process further includes the step of selecting said seat, lumbar, and thoracic support members from a series of standardized support members.

12. A process of manufacturing a customized chair as claimed in claim 10, wherein said process further includes cutting said floor support member to define the seat height and orienting said universal C within said support member to define seat tilt.

13. A process of manufacturing a customized chair as claimed in claim 10, wherein said seat tilt can be altered by cutting said floor support member, or by orienting said universal C in said floor support member, or by a combination of both.

14. A process of manufacturing a customized chair as claimed in claim 10, which further includes the steps of cutting at least a pair of mounting blocks for each support member and mounting said blocks on a pair of universal C-frame members.

15. A measuring chair for customizing an upholstered chair to a specific individual, said measuring chair comprising:

(a) a lower frame member having a mounting means defined thereon to receive an upholstered seat member, said lower frame member having at least two hydraulically actuated vertically adjustable support means, one in the front and one in the rear of said lower frame member, said adjustable support means defining a seat height and a seat angle with respect to a floor, (b) a plurality of hydraulically actuated movable sub-frame members attached to said lower frame member, and extending upwardly from said lower frame member at an obtuse angle, said sub-frames defining an adjustable and reciprocating lumbar sub-frame, a thoracic sub-frame with adjustable and reciprocating and angular movements, and cervical sub-frame having an adjustable and reciprocating motion, each of said sub-frames having defined thereon a mounting means to receive an upholstered support member, (c) a plurality of upholstered support members, said members including a seat member, lumbar member, a thoracic member, and cervical member, each of said members defining a curved rigid shell with means to mount said shells on said lower frame and sub-frames, each of said support members also including an upholstered portion, whereby the upholstered sections combine together to define a chair for the person to be measured therein.

16. A measuring chair as claimed in claim 15 wherein said means to mount said shells defines a pair of clips mounted on the rigid shell portion of said upholstered members, said clips engaging to hook over and be retained by their respective sub-frame member.

17. A measuring chair as claimed in claim 16 wherein each of said upholstered supports is divided as a set of support members, with each member within a set having a different density in the upholstered portion.

18. A measuring chair as claimed in claim 15, wherein each of said sub-frames defines a pointer which traverses a scale to define the measurements of the movement of that sub-frame, said scale being attached to the immediately preceding frame or sub-frame.

19. A measuring chair as claimed in claim 15, wherein the angle between the lumbar support and the seat is fixed.

* * * * *